US011607581B2

(12) United States Patent
Campbell

(10) Patent No.: US 11,607,581 B2
(45) Date of Patent: Mar. 21, 2023

(54) ROWING EXERCISE ASSEMBLY

(71) Applicant: Lisa Campbell, Conyers, GA (US)

(72) Inventor: Lisa Campbell, Conyers, GA (US)

( * ) Notice: Subject to any disclaimer, the term of this patent is extended or adjusted under 35 U.S.C. 154(b) by 127 days.

(21) Appl. No.: 17/082,258

(22) Filed: Oct. 28, 2020

(65) Prior Publication Data

US 2022/0126164 A1 Apr. 28, 2022

(51) Int. Cl.

| | |
|---|---|
| ***A63B 22/00*** | (2006.01) |
| ***A63B 71/06*** | (2006.01) |
| ***A63B 24/00*** | (2006.01) |
| ***A63B 21/00*** | (2006.01) |

(52) U.S. Cl.

CPC ..... *A63B 22/0076* (2013.01); *A63B 21/154* (2013.01); *A63B 21/4034* (2015.10); *A63B 21/4035* (2015.10); *A63B 24/0087* (2013.01); *A63B 71/0622* (2013.01); *A63B 2022/0079* (2013.01); *A63B 2071/0658* (2013.01); *A63B 2071/0694* (2013.01); *A63B 2225/093* (2013.01)

(58) Field of Classification Search

CPC ..... A63B 21/005; A63B 21/0051; A63B 21/0052; A63B 21/0056; A63B 21/0057; A63B 21/008; A63B 21/012; A63B 21/15; A63B 21/151; A63B 21/154; A63B 21/22; A63B 21/225; A63B 21/4027; A63B 21/4029; A63B 21/4033; A63B 21/4035; A63B 21/4045; A63B 22/0015; A63B 22/0023; A63B 22/0025; A63B 22/0046; A63B 22/0076; A63B 22/0087; A63B 22/20; A63B 22/201; A63B 22/203; A63B 2022/0035; A63B 2022/0041; A63B 2022/0079; A63B 24/0062; A63B 24/0087; A63B 69/06; A63B 2069/062; A63B 71/0619; A63B 71/0622; A63B 2071/0658; A63B 2071/0694; A63B 2225/09; A63B 2225/093

See application file for complete search history.

(56) References Cited

U.S. PATENT DOCUMENTS 1,205,426 A * 11/1916 Barnhill ..... A63B 22/0087 482/72
4,974,832 A * 12/1990 Dalebout ..... A63B 21/4029 482/142
5,072,929 A 12/1991 Peterson
(Continued)

FOREIGN PATENT DOCUMENTS

GB 2583958 A * 11/2020 ..... A63B 22/0076

*Primary Examiner* — Gary D Urbiel Goldner

(57) ABSTRACT

A rowing exercise assembly includes a pair of elevation units that is each positionable at a selected point between a minimum elevation and a maximum elevation. A rowing machine is coupled between each of the elevation units thereby facilitating the rowing machine to be positionable at a variety of horizontal angles. In this way the elevation units enhance rowing exercises. A pair of cables is coupled to a resistance unit. A pair of handles is respectively coupled to the pair of cables and each of the handles may be gripped for performing the rowing exercises. A control is positioned proximate to the rowing machine and each of the elevation units is electrically coupled to the control. Moreover, the control actuates each of the elevation units to be positioned at the selected point between the minimum and maximum elevations.

12 Claims, 8 Drawing Sheets

(56) References Cited

U.S. PATENT DOCUMENTS

| | | | | |
|---|---|---|---|---|
| 5,295,931 | A * | 3/1994 | Dreibelbis | A63B 21/1609 482/125 |
| 5,752,879 | A * | 5/1998 | Berdut | A63B 22/0023 482/142 |
| 5,820,478 | A * | 10/1998 | Wood | A63B 69/3652 473/279 |
| 6,991,589 | B1 * | 1/2006 | Patterson | A63B 21/00069 482/142 |
| 7,270,628 | B2 | 9/2007 | Campanaro | |
| 8,192,332 | B2 * | 6/2012 | Baker | A63B 69/06 482/133 |
| 9,028,374 | B1 * | 5/2015 | Brady | A63B 22/16 482/72 |
| D741,420 | S | 10/2015 | Campanaro | |
| 9,415,257 | B2 | 8/2016 | Habing | |
| 9,517,375 | B2 | 12/2016 | Lagree | |
| 10,518,125 | B2 * | 12/2019 | Janowski | A63B 23/1209 |
| 10,857,418 | B2 * | 12/2020 | Lagree | A63B 21/4047 |
| 11,413,494 | B1 * | 8/2022 | Habing | A63B 21/227 |
| 2006/0009334 | A1 * | 1/2006 | Smith | A63B 22/0023 482/72 |
| 2006/0009335 | A1 * | 1/2006 | Smith | A63B 21/153 482/72 |
| 2010/0288901 | A1 * | 11/2010 | Wallach | A63B 22/0076 248/346.03 |
| 2016/0107023 | A1 | 4/2016 | Campanaro | |
| 2016/0166870 | A1 | 6/2016 | Lagree | |
| 2018/0214734 | A1 * | 8/2018 | Lammers | A63B 21/225 |
| 2019/0351283 | A1 * | 11/2019 | Smith | A63B 21/0057 |

* cited by examiner

ROWING EXERCISE ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to rowing device assemblies and more particularly pertains to a new rowing device assembly for performing enhanced rowing exercises.

BRIEF SUMMARY OF THE INVENTION

An embodiment of the disclosure meets the needs presented above by generally comprising a pair of elevation units that is each positionable at a selected point between a minimum elevation and a maximum elevation. A rowing machine is coupled between each of the elevation units thereby facilitating the rowing machine to be positionable at a variety of horizontal angles. In this way the elevation units enhances rowing exercises for a user. A pair of cables is each of the cables is coupled to the resistance unit. A pair of handles is each coupled to a respective one of the cables and each of the handles may be gripped for performing rowing exercises. A control is positioned proximate the rowing machine and each of the elevation units is electrically coupled to the control. Moreover, the control actuates each of the elevation units to be positioned at the selected point between the minimum and maximum elevations.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
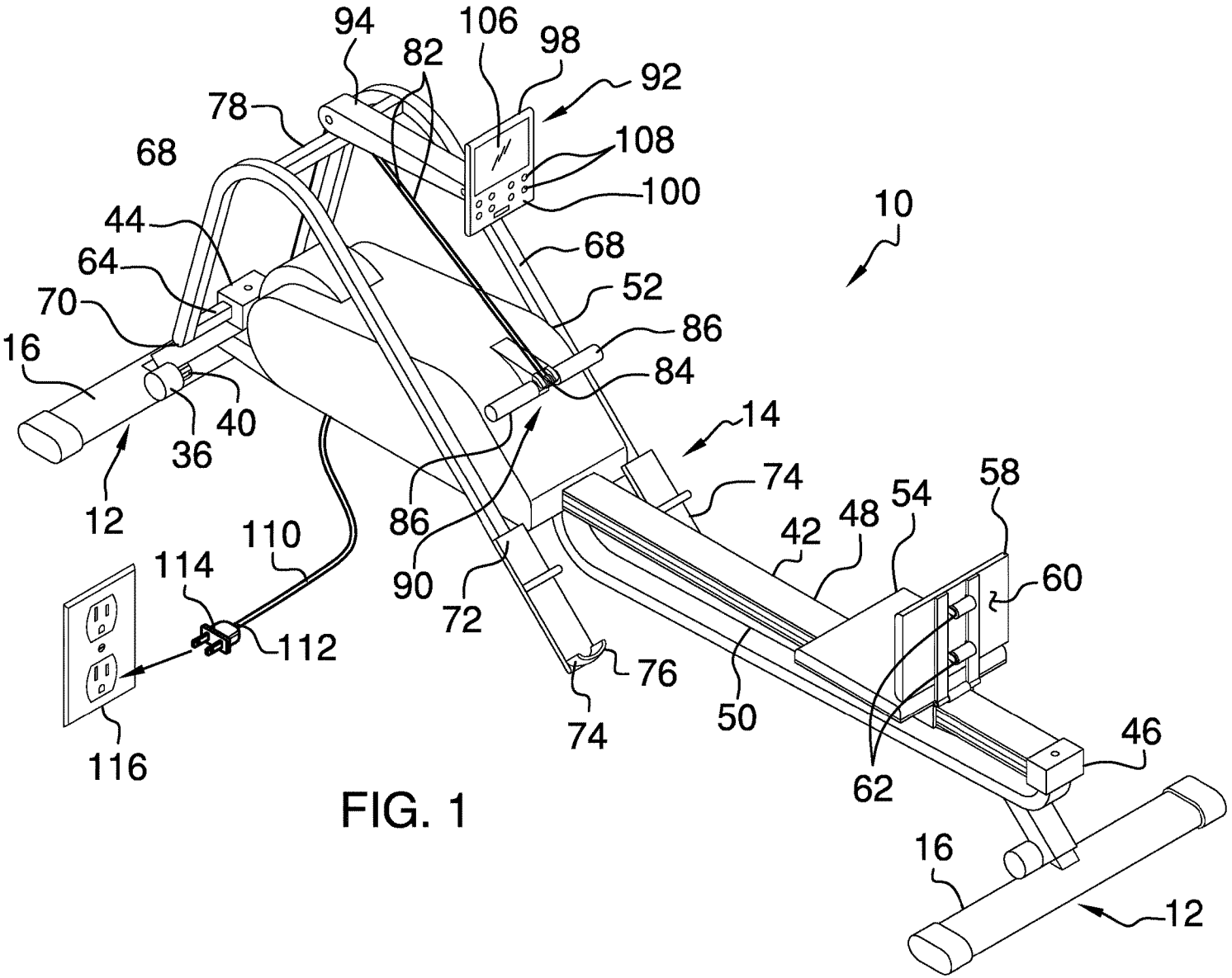
FIG. 1 is a top perspective view of a rowing exercise assembly according to an embodiment of the disclosure.
Figure 2:
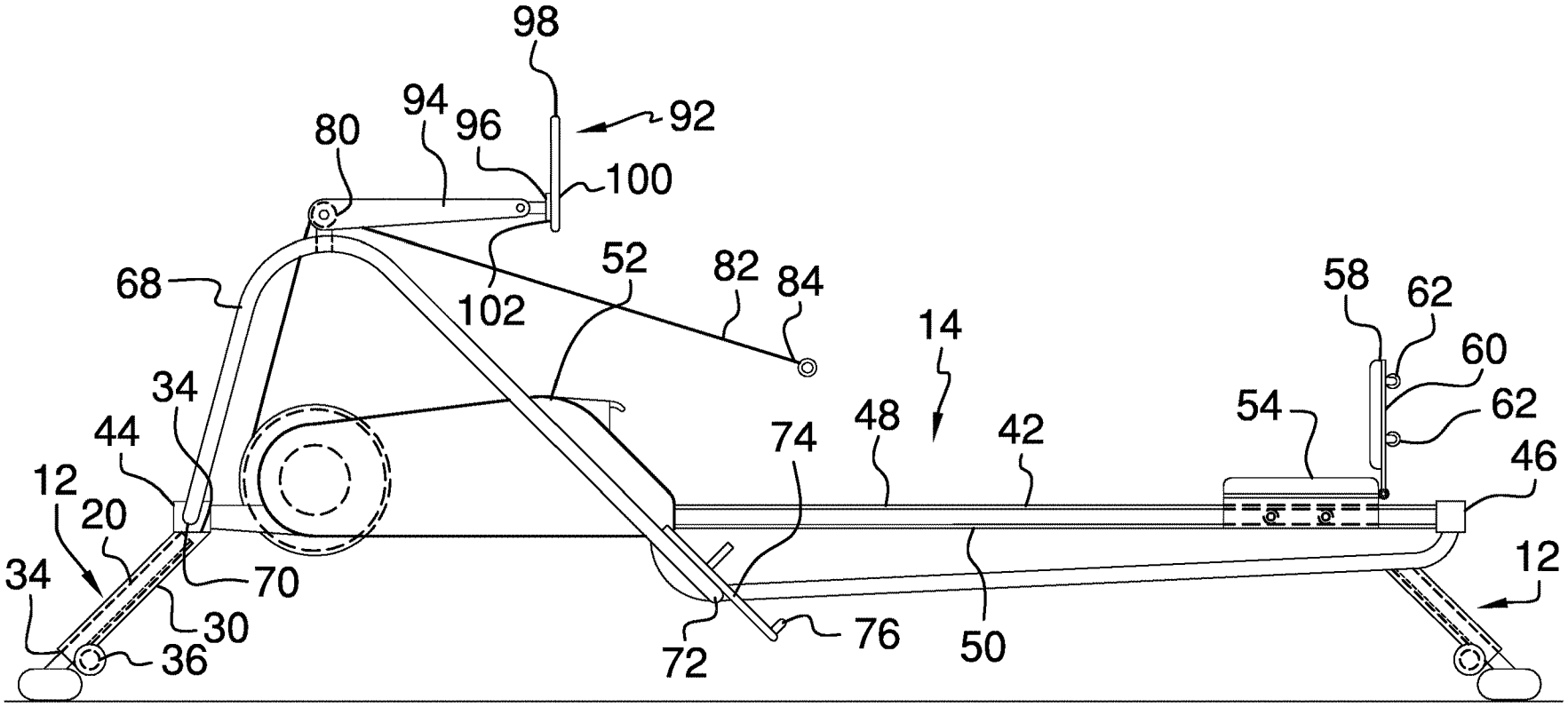
FIG. 2 is a left side phantom view of an embodiment of the disclosure.
Figure 3:
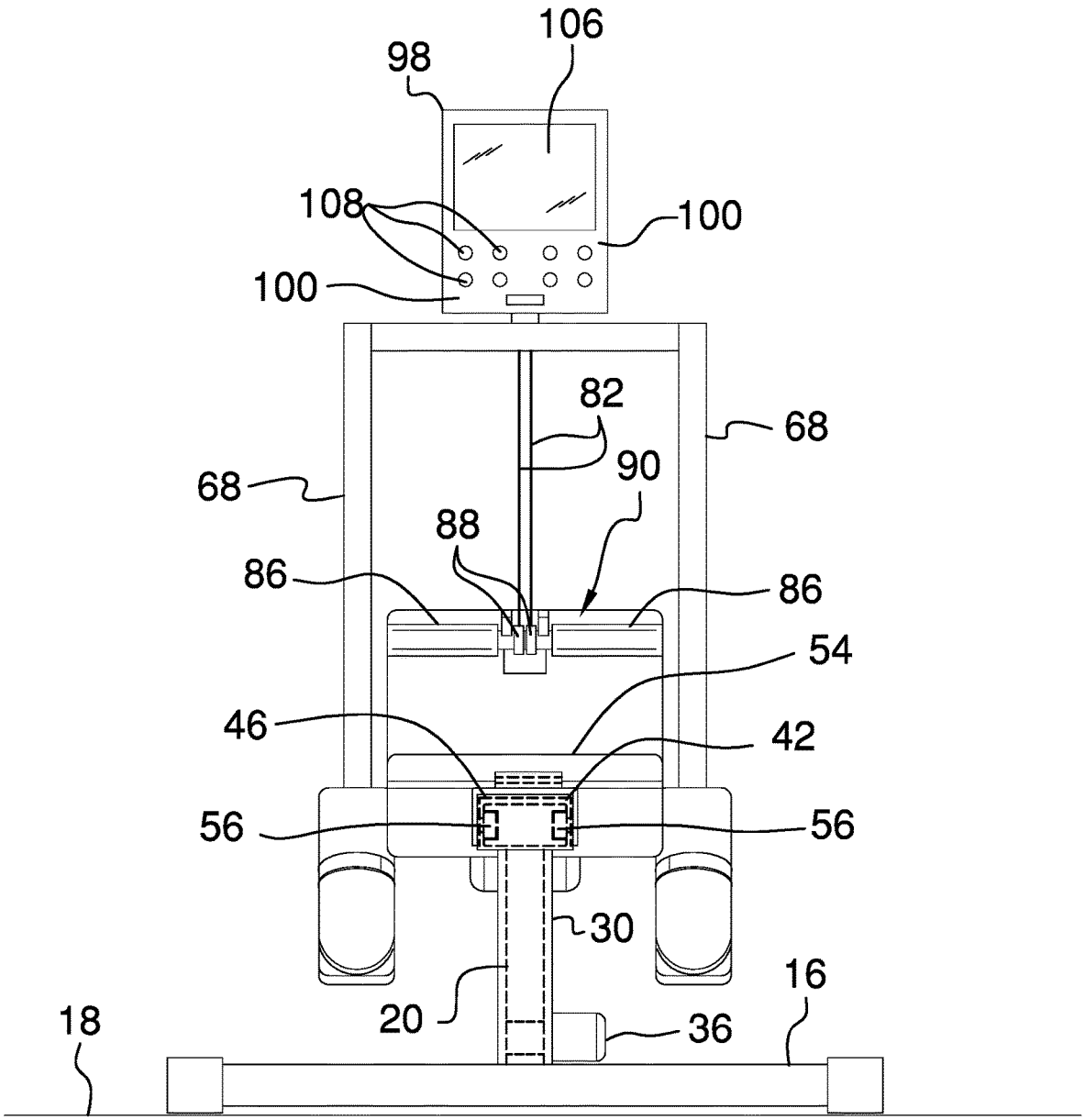
FIG. 3 is a back phantom view of an embodiment of the disclosure.
Figure 4:
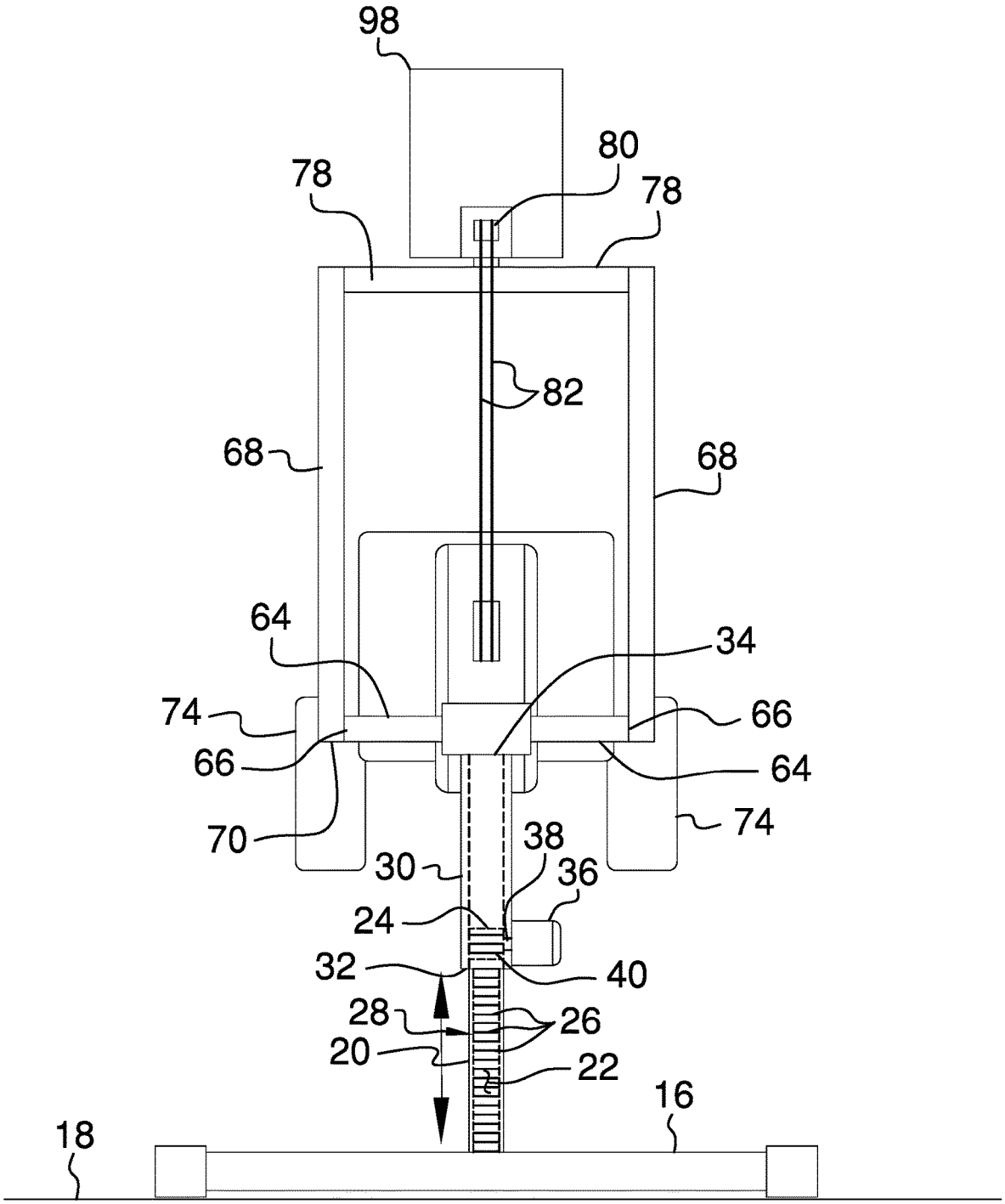
FIG. 4 is a front view of an embodiment of the disclosure.

With reference now to the drawings, and in particular to FIGS. 1 through 8 thereof, a new rowing device assembly embodying the principles and concepts of an embodiment of the disclosure and generally designated by the reference numeral 10 will be described.

As best illustrated in FIGS. 1 through 8, the rowing exercise assembly 10 generally comprises a pair of elevation units 12. Each of the elevation units 12 is positionable at a selected point between a minimum elevation and a maximum elevation. A rowing machine 14 is coupled between each of the elevation units 12 thereby facilitating the rowing machine 14 to be positionable at a variety of horizontal angles. In this way the elevation units 12 can enhance rowing exercises for a user by allowing the user to perform rowing exercises on an incline or a decline.

Each of the elevation units 12 comprises a leg 16 that is horizontally oriented to rest on a support surface 18 such as a floor or the like. A member 20 is coupled to and extends upwardly from the leg 16, the member 20 is centrally positioned on the leg 16 and the member 20 is oriented at an acute angle with the leg 16. The member 20 has a first surface 22 and a distal end 24, and the first surface 22 has a plurality of indentations 26 thereon. Each of the indentations 26 is horizontally oriented on the first surface 22. Additionally, the indentations 26 are spaced apart from each other and are distributed between the leg 16 and the distal end 26 such that the plurality of indentations 26 defines a rack gear 28 on the member 20.

Each of the elevation units 12 includes a sleeve 30 that has a first end 32 and a second end 34. The first end 32 of the sleeve 30 insertably receives the distal end 26 of the member 20 such that the sleeve 30 is slidable upwardly and downwardly along the member 20. A motor 36 is coupled to the sleeve 30, the motor 36 has a drive shaft 38 extending into an interior of the sleeve 30 and the motor 36 is rotatable in a first direction or a second direction. The motor 36 may be an electric motor or the like. A gear 40 is rotatably coupled to the drive shaft 38 such that the gear 40 is positioned within the sleeve 30 and the gear 40 engages the rack gear 28 on the member 20. The sleeve 30 is urged upwardly along the member 20 when the motor 36 rotates in the first direction. Moreover, the sleeve 30 is urged downwardly along the member 20 when the motor 36 rotates in the second direction. In this way each of the elevation units 12 can be adjusted between the minimum and maximum elevations.

The rowing machine 14 comprises a seat track 42 that has a first end 44, a second end 46 a top side 48 and a bottom side 50. The bottom side 50 has the second end 46 of the sleeve 30 of each of the elevation units 12 coupled thereto. Thus, each of the elevation units 12 positions the seat track 42 at a selected horizontal angle. The sleeve 30 of each of the elevation units 12 is aligned with a respective one of the first 32 and second 34 ends of the seat track 42. The rowing machine 14 includes a resistance unit 52 that is positioned on the seat track 42. The resistance unit 52 is positioned closer to the first end 32 than the second end 34. Additionally, the resistance unit 52 may be a flywheel, a hydraulic resistance unit or any other convention means of imparting rotational resistance on a rowing machine 14.

A seat 54 is slidably coupled to the top side 48 of the seat track 42 and the seat 54 can be mounted by a user. The seat 54 is rollable between the resistance unit 52 and the second end 34 of the seat track 42. A plurality of seat rollers 56 is each rotatably coupled to a bottom surface of the seat 54. Each of the seat rollers 56 engages the top side 48 of the seat track 42 for rolling along the seat track 42.

A back rest 58 is provided and the back rest 58 is pivotally coupled to the seat 54. The back rest 58 is positionable in an upright position having the back rest 58 lying on a plane that is oriented perpendicular to a top surface of the seat 54. The back rest 58 is positionable in a reclined position having the back rest 58 lying on a plane that is coplanar with the top surface of the seat 54. The back rest 58 has a rear surface 60 and a pair of back rest rollers 62 is each rotatably coupled to the rear surface 60 of the back rest 58. Each of the back rest rollers 62 engages the top side 48 of the seat track 42 when the back rest 58 is positioned in the reclined position for rolling along the seat track 42. In this way the user can lie on the seat 54 and the back rest 58 for performing exercises other than rowing exercises.

A pair of supports 64 is each coupled to and extends laterally away from the seat track 42 in opposite directions from each other. Each of the supports 64 is aligned with the first end 32 of the seat track 42 and each of the supports 64 has a distal end 66 with respect to the seat track 42. A pair of foot members 68 is provided and each of the foot members 68 has a primary end 70 and a secondary end 72. Moreover, each of the foot members 68 is curved between the primary 70 and secondary 72 ends having the primary 70 and secondary 72 ends being spaced from each other such that each of the foot members 68 has a U shape. The primary end 70 of each of the foot members 68 is coupled to the distal end 66 of a respective one of the supports 64 having each of the foot members 68 arcing upwardly and rearwardly from the respective support 64. Additionally, each of the foot members 68 is coupled to an outer wall of the resistance unit 52 and the secondary end 72 of each of the foot members 68 is positioned between the resistance unit 52 and the second end 34 of the seat track 42.

A pair of foot rests 74 is each coupled to a respective one of the foot members 68. Each of the foot rests 74 is aligned with the secondary end 72 of the respective foot member 20 and each of the foot rests 74 includes a saddle 76 for supporting a heel of the user's foot. A pulley support 78 is coupled between each of the foot members 68 and the pulley support 78 is aligned with an apex of each of the foot members 68. A pulley 80 is rotatably coupled to the pulley support 78 and the pulley 80 is centrally positioned between the foot members 68. Thus, the pulley 80 is positioned above the resistance unit 52.

A pair of cables 82 is each coupled to the resistance unit 52 such that each of the cables 82 is selectively drawn outwardly from the resistance unit 52. The resistance unit 52 biases each of the cables 82 to be drawn inwardly therein to impart resistance in each of the cables 82 for performing rowing exercises. Each of the cables 82 has a distal end 84 with respect to the resistance unit 52 and each of the cables 82 extends upwardly around the pulley 80 having the distal end 84 of each of the cables 82 being positioned between the resistance unit 52 and the second end 34 of the seat track 42.

A pair of handles 86 is provided and each of the handles 86 is coupled to the distal end 84 of a respective one of the cables 82. Each of the handles 86 is gripped for performing rowing exercises when the user is seated on the seat 54 and the user's feet are placed on the foot rests 74. Each of the handles 86 has a first end 88, and the first end 88 of each of the handles 86 is releasably coupled together having the handles 86 defining a bar 90. Thus, the bar 90 is gripped for performing traditional rowing exercises. The handles 86 can be uncoupled from each other thereby facilitating each of the handles 86 to be moved independently of each other. In this way additional exercises can be performed beyond the traditional rowing exercises.

A control 92 is provided and the control 92 is positioned proximate the rowing machine 14 such that the control 92 can be manipulated by the user when the user sits on the seat 54. Each of the elevation units 12 is electrically coupled to the control 92 such that the control 92 actuates each of the elevation units 12 to be positioned at the selected point between the minimum and maximum elevations. Additionally, the resistance unit 52 may be electrically coupled to the control 92 for adjusting the degree of resistance posed by the resistance unit 52.

The control 92 comprises a control member 94 that is coupled to and extends rearwardly from the pulley support 78. The control member 94 has a distal end 96 with respect to the pulley support 78. A housing 98 is included that has a back wall 100 and a front wall 102, and the front wall 102 is coupled to the distal end 96 of the control member 94 such that the back wall 100 is visible to the user. A control circuit 104 is positioned within the housing 98, the motor 36 of each of the elevation units 12 is electrically coupled to the control circuit 104 and the resistance unit 52 is electrically coupled to the control circuit 104.

A display 106 is coupled to the back wall 100 of the housing 98 and the display 106 is electrically coupled to the control circuit 104. The display 106 displays indicia comprising operational parameters of the elevation units 12 and the resistance unit 52. The display 106 may be an LCD display or other type of electronic video display. A plurality of buttons 108 is each movably coupled to the back wall 100 of the housing 98. Each of the buttons 108 is electrically coupled to the control circuit 104 for controlling operational parameters of the elevation units 12 and the resistance unit 52. The plurality of buttons 108 may include a power button, an up button for inclining the seat track, a down button for declining the seat track and button for adjusting resistance of the resistance unit. A power cord 110 is coupled to and extends outwardly from the housing 98. The power cord 110 has a distal end 112 and a plug 114 is electrically coupled to the distal end of the power cord 110. The plug 114 is electrically coupled to a power source 116, such as a female electrical outlet or the like.

Figure 7:
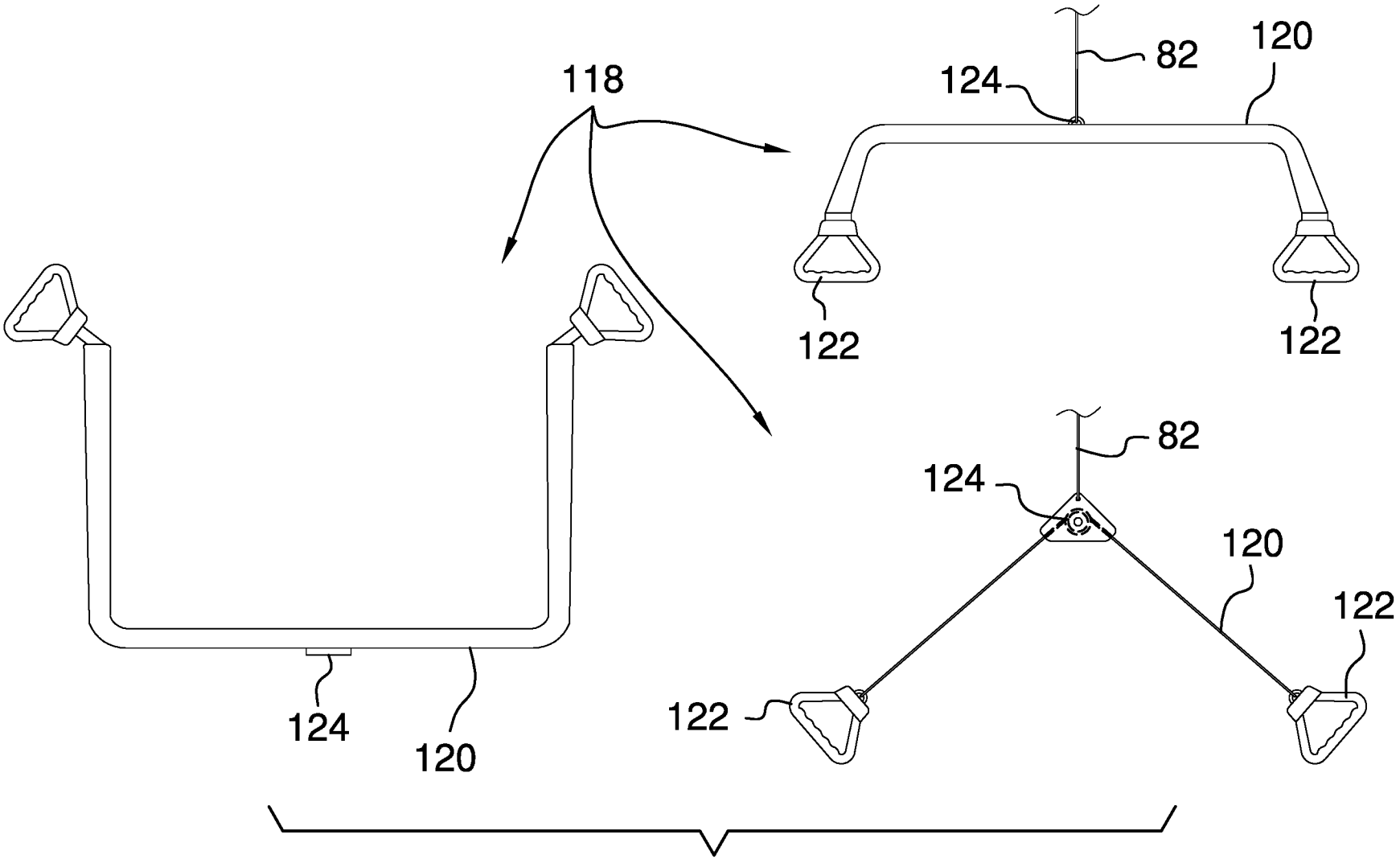
FIG. 7 is a perspective view of a plurality of handle attachments of an embodiment of the disclosure.
Figure 8:
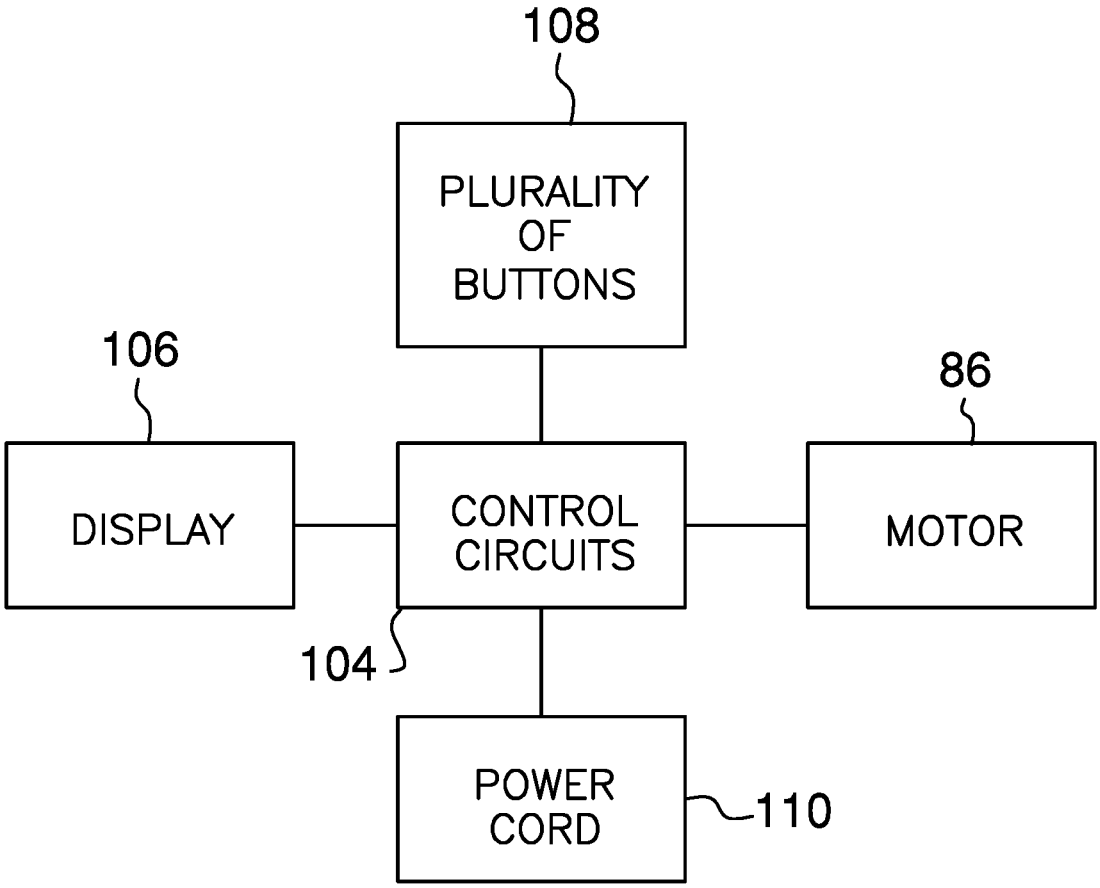
FIG. 8 is a schematic view of an embodiment of the disclosure.

As shown in FIG. 7, a plurality of handle attachments 118 may be provided. Each of the handle attachments 118 may have a cable 120 that extends between a pair of grips 122. The cable 120 of each of the handle attachments 118 may have an attachment point 124 that is centrally positioned between each of the grips 122. Moreover, each of the cables 82 extending out of the resistance unit 52 may be releasably attachable to the attachment point 124. Thus, each of the grips 122 of any of the handle attachments 118 may be gripped for performing exercises.

Figure 5:
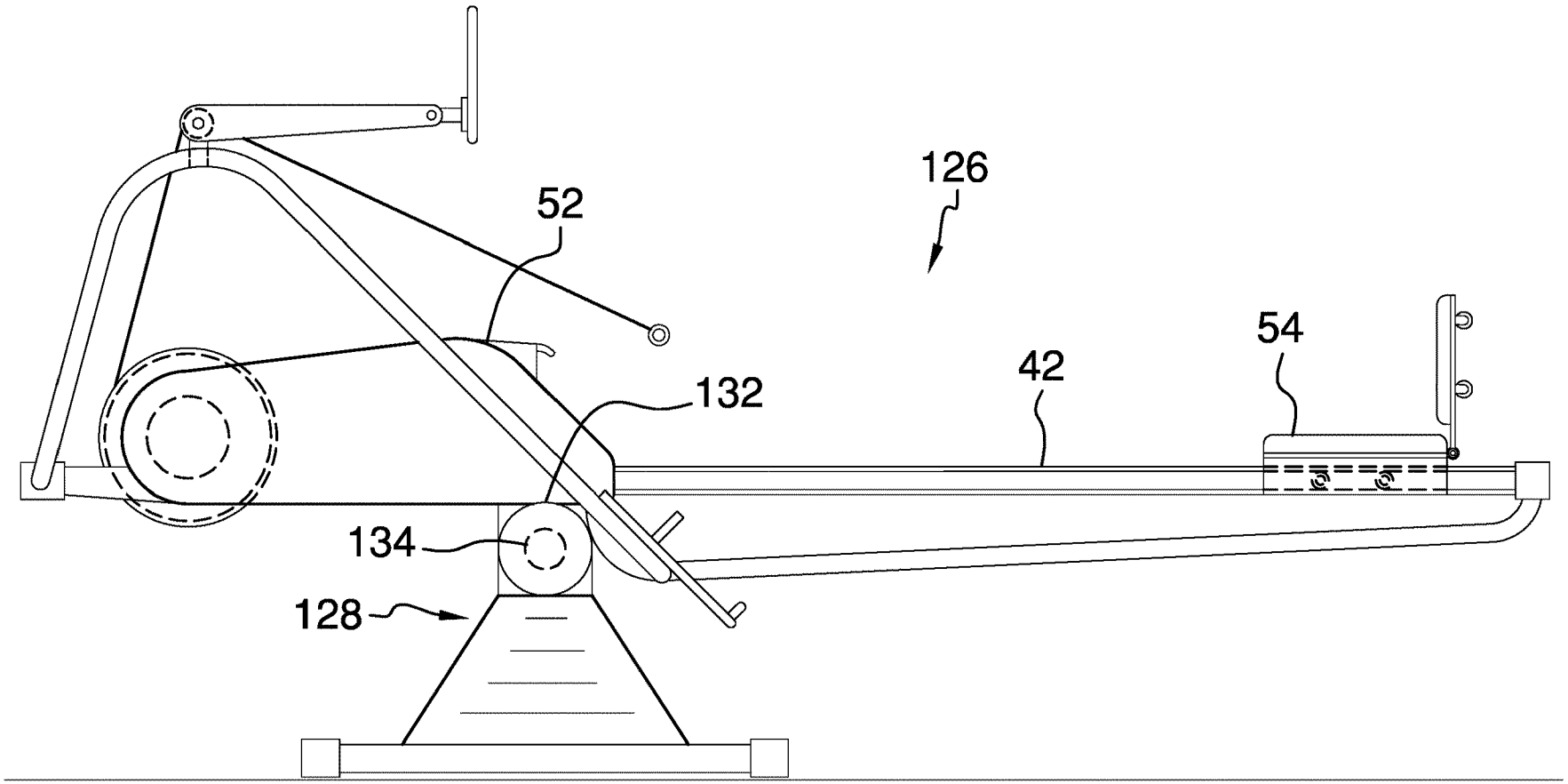
FIG. 5 is a left side view of an alternative embodiment of the disclosure.
Figure 6:
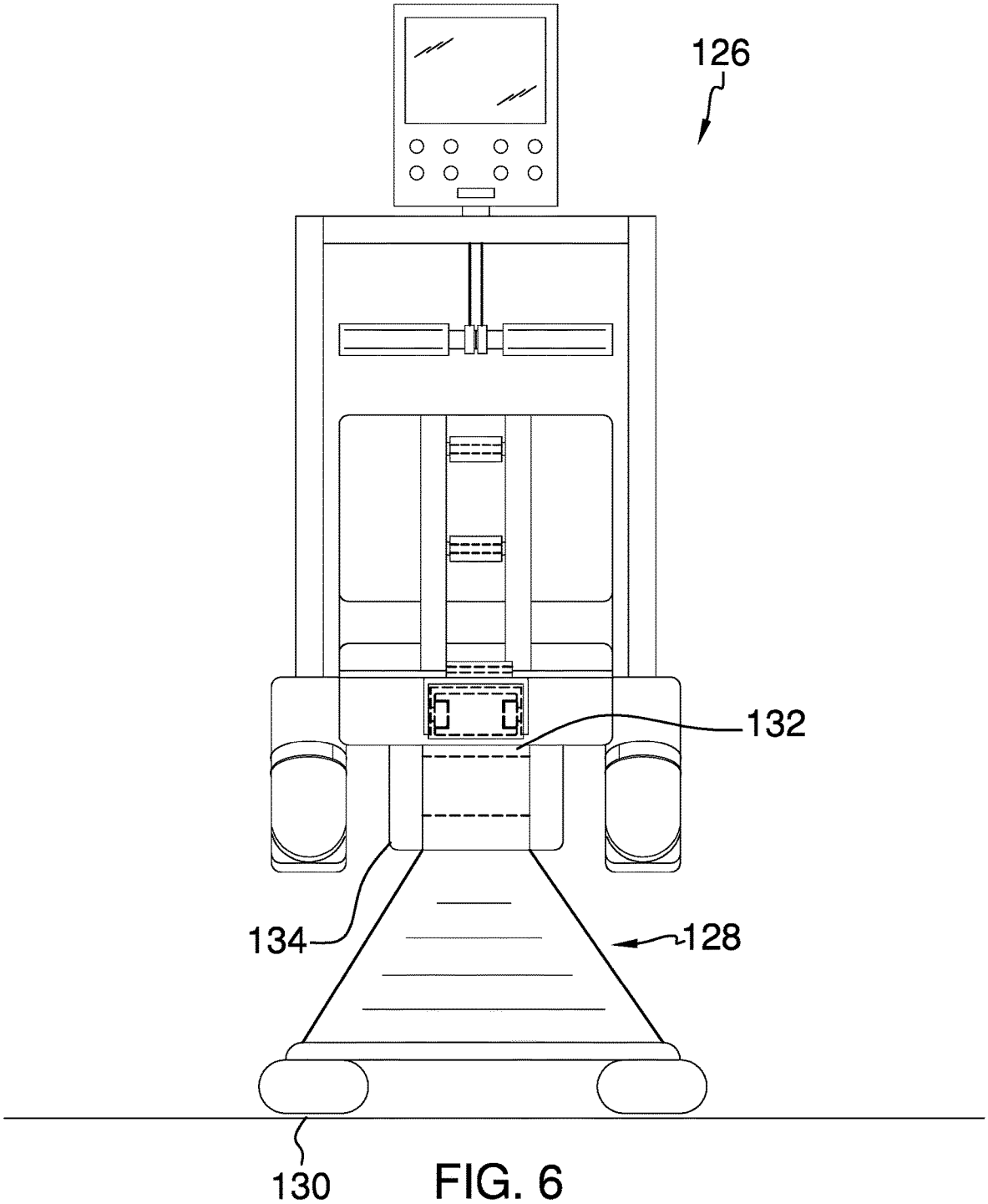
FIG. 6 is a back view of an alternative embodiment of the disclosure.

In an alternative embodiment 126 as shown in FIGS. 5 and 6, a fulcrum unit 128 may be provided that has a basal end 130 and top end 132. The fulcrum unit 128 may angle inwardly between the basal 130 and top 132 ends such that the fulcrum unit 128 defines a triangular shape. The top end 132 of the fulcrum unit 128 has the bottom side 50 of the seat track 42 being pivotally coupled thereto. Additionally, the top end 132 of the fulcrum unit 128 is centrally positioned between the first 32 and second 34 ends of the seat track 42.

A fulcrum motor 134 is provided and the fulcrum motor 134 is positioned within the fulcrum unit 128. The fulcrum motor 134 is electrically coupled to the control circuit 104 and the fulcrum motor 134 engages the seat track 42. The fulcrum motor 134 rotates in a first direction or a second direction, and the fulcrum motor 134 may be an electric motor 36 or the like. The first end 32 of the seat track 42 is urged upwardly when the fulcrum motor 134 rotates in the first direction. Thus, the seat track 42 can be inclined between the second end 34 and the resistance unit 52. The first end 32 of the seat track 42 is urged downwardly when the fulcrum motor 134 rotates in the second direction. In this way the seat track 42 to be declined between the second end 34 and the resistance unit 52.

In use, the user sits on the seat 54 and grips the handles 86 for performing traditional rowing exercises. Additionally, either of the elevation units 12 can be actuated to selectively incline or decline the seat track 42. In this way the traditional rowing exercises are enhanced. The handles 86 can be broken apart thereby facilitating a variety of additional exercises to be performed beyond traditional rowing exercises. Each of the handles 86 can be uncoupled from the cables 82 and the cables 82 can be attached to a selected one of the handle attachments 118 for performing an even greater variety of exercises. Moreover, the back rest 58 can be selectively positioned in the reclined position thereby facilitating the user to perform exercises while lying down.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A rowing exercise assembly having an adjustable inclination wherein said assembly is configured to enhance rowing exercises, said assembly comprising:

a pair of elevation units, each of said elevation units being positionable at a selected point between a minimum elevation and a maximum elevation;

a rowing machine being coupled between each of said elevation units thereby facilitating said rowing machine to be positionable at a variety of horizontal angles wherein said elevation units are configured to enhance the rowing exercises for a user;

a pair of cables coupled to a resistance unit of said rowing machine such that each of said cables is selectively drawn outwardly from said resistance unit, said resistance unit biasing each of said cables to be drawn inwardly therein wherein said resistance unit is configured to impart resistance in each of said cables for performing the rowing exercises;

a pair of handles, each of said handles being coupled to a distal end of a respective one of said cables wherein each of said handles is configured to be gripped for performing the rowing exercises;

a control being positioned proximate to said rowing machine wherein said control is configured to be manipulated by the user, each of said elevation units being electrically coupled to said control such that said control actuates each of said elevation units to be positioned at said selected point between said minimum and maximum elevations; and wherein each of said elevation units comprises:

a leg being horizontally oriented to rest on a support surface; and a member being coupled to and extending upwardly from said leg, said member being centrally positioned on said leg, said member being oriented at an acute angle with said leg, said member having a first surface and a distal end, said first surface having a plurality of indentations thereon, each of said indentations being horizontally oriented on said first surface, said indentations being spaced apart from each other and being distributed between said leg and said distal end such that said plurality of indentations defines a rack gear on said member.

2. The assembly according to claim 1, wherein each of said elevation units further comprises:

a sleeve having a first end and a second end, said first end of said sleeve insertably receiving said distal end of said member such that said sleeve is slidable upwardly and downwardly along said member;

a motor being coupled to said sleeve, said motor having a drive shaft extending into an interior of said sleeve, said motor being rotatable in a first direction and a second direction; and a gear being rotatably coupled to said drive shaft such that said gear is positioned within said sleeve, said gear engaging said rack gear on said member, said sleeve being urged upwardly along said member when said motor rotates in said first direction, said sleeve being urged downwardly along said member when said motor rotates in said second direction.

3. The assembly according to claim 2, wherein said rowing machine comprises a seat track having a first end, a second end, a top side, and a bottom side, said bottom side having said second end of said sleeve of each of said elevation units being coupled thereto such that each of said elevation units positions said seat track at a selected horizontal angle, said sleeve of each of said elevation units being aligned with a respective one of said first and second ends of said seat track.

4. The assembly according to claim 3, wherein said rowing machine further comprises:

said resistance unit being positioned on said seat track, said resistance unit being positioned closer to said first end than said second end of said seat track;

a seat being slidably coupled to said top side of said seat track wherein said seat is configured to be mounted by said user, said seat being rollable between said resistance unit and said second end of said seat track; and a plurality of seat rollers, each of said seat rollers being rotatably coupled to a bottom surface of said seat, each of said seat rollers engaging said top side of said seat track for rolling along said seat track.

5. The assembly according to claim 4, wherein said rowing machine further comprises:

a back rest being pivotally coupled to said seat, said back rest being positionable in an upright position having said back rest lying on a plane being oriented perpendicular to a top surface of said seat, said back rest being positionable in a reclined position having said back rest lying on a plane being coplanar with said top surface of said seat, said back rest having a rear surface; and a pair of back rest rollers, each of said back rest rollers being rotatably coupled to said rear surface of said back rest, each of said back rest rollers engaging said top side of said seat track when said back rest is positioned in said reclined position for rolling along said seat track.

6. The assembly according to claim 3, further comprising:

a pair of supports, each of said supports being coupled to and extending laterally away from said seat track in opposite directions from each other, each of said supports being aligned with said first end of said seat track, each of said supports having a distal end with respect to said seat track; and a pair of toot members, each of said foot members having a primary end and a secondary end, each of said foot members being curved between said primary and secondary ends and having said primary and secondary ends being spaced from each other such that each of said toot members has a U shape, said primary end of each of said foot members being coupled to said distal end of a respective one of said supports and having each of said foot members arcing upwardly and rearwardly from said respective support, each of said foot members being coupled to an outer wall of said resistance unit of said rowing machine.

7. The assembly according to claim 6, further comprising a pair of foot rests, each of said foot rests being coupled to a respective one of said foot members, each of said foot rests being aligned with said secondary end of said respective foot member, each of said foot rests including a saddle for supporting a heel of the user's foot.

8. The assembly according to claim 6, further comprising:

a pulley support being coupled between each of said foot members, said pulley support being aligned with an apex of each of said foot members; and a pulley being rotatably coupled to said pulley support, said pulley being centrally positioned between said foot members.

9. The assembly according to claim 8, wherein said control comprises:

a control member being coupled to and extending rearwardly from said pulley support, said control member having a distal end with respect to said pulley support; and a housing having a back wall and a front wall, said front wall being coupled to said distal end of said control member wherein said back wall is configured to be visible to the user.

10. The assembly according to claim 9, further comprising:

a control circuit being positioned within said housing, said control circuit having said motor of each of said elevation units being electrically coupled thereto, said resistance unit being electrically coupled to said control circuit;

a display being coupled to said back wall of said housing, said display being electrically coupled to said control circuit, said display displaying indicia comprising operational parameters of said elevation units and said resistance unit; and a plurality of buttons, each of said buttons being movably coupled to said back wall of said housing, each of said buttons being electrically coupled to said control circuit for controlling said operational parameters of said elevation units and said resistance unit.

11. The assembly according to claim 10, further comprising a power cord being coupled to and extending outwardly from said housing, said power cord having a distal end, said distal end of said power cord having a plug being electrically coupled thereto, said plug being electrically coupled to a power source.

12. A rowing exercise assembly having an adjustable inclination wherein said assembly is configured to enhance rowing exercises, said assembly comprising:

a pair of elevation units, each of said elevation units being positionable at a selected point between a minimum elevation and a maximum elevation;

a rowing machine being coupled between each of said elevation units thereby facilitating said rowing machine to be positionable at a variety of horizontal angles wherein said elevation units are configured to enhance the rowing exercises for a user, each of said elevation units comprising:

a leg being horizontally oriented to rest on a support surface;

a member being coupled to and extending upwardly from said leg, said member being centrally positioned on said leg, said member being oriented at an acute angle with said leg, said member having a first surface and a distal end, said first surface having a plurality of indentations thereon, each of said indentations being horizontally oriented on said first surface, said indentations being spaced apart from each other and being distributed between said leg and said distal end such that said plurality of indentations defines a rack gear on said member;

a sleeve having a first end and a second end, said first end of said sleeve insertably receiving said distal end of said member such that said sleeve is slidable upwardly and downwardly along said member;

a motor being coupled to said sleeve, said motor having a drive shaft extending into an interior of said sleeve, said motor being rotatable in a first direction and a second direction; and a gear being rotatably coupled to said drive shaft such that said gear is positioned within said sleeve, said gear engaging said rack gear on said member, said sleeve being urged upwardly along said member when said motor rotates in said first direction, said sleeve being urged downwardly along said member when said motor rotates in said second direction;

said rowing machine comprises:

a seat track having a first end, a second end, a top side, and a bottom side, said bottom side having said second end of said sleeve of each of said elevation units being coupled thereto such that each of said elevation units positions said seat track at a selected horizontal angle, said sleeve of each of said elevation units being aligned with a respective one of said first and second ends of said seat track;

a resistance unit being positioned on said seat track, said resistance unit being positioned closer to said first end than said second end of said seat track;

a seat being slidably coupled to said top side of said seat track wherein said seat is configured to be mounted by the user, said seat being rollable between said resistance unit and said second end of said seat track;

a plurality of seat rollers, each of said seat rollers being rotatably coupled to a bottom surface of said seat, each of said seat rollers engaging said top side of said seat track for rolling along said seat track;

a back rest being pivotally coupled to said seat, said back rest being positionable in an upright position having said back rest lying on a plane being oriented perpendicular to a top surface of said seat, said back rest being positionable in a reclined position having said back rest lying on a plane being coplanar with said top surface of said seat, said back rest having a rear surface; and a pair of back rest rollers, each of said back rest rollers being rotatably coupled to said rear surface of said back rest, each of said back rest rollers engaging said top side of said seat track when said back rest is positioned in said reclined position for rolling along said seat track;

a pair of supports, each of said supports being coupled to and extending laterally away from said seat track in opposite directions from each other, each of said supports being aligned with said first end of said seat track, each of said supports having a distal end with respect to said seat track;

a pair of foot members, each of said foot members having a primary end and a secondary end, each of said foot members being curved between said primary and secondary ends and having said primary and secondary ends being spaced from each other such that each of said foot members has a shape, said primary end of each of said foot members being coupled to said distal end of a respective one of said supports and having each of said foot members arcing upwardly and rearwardly from said respective support, each of said foot members being coupled to an outer wall of said resistance unit;

a pair of foot rests, each of said foot rests being coupled to a respective one of said foot members, each of said foot rests being aligned with said secondary end of said respective foot member, each of said foot rests including a saddle for supporting a heel of the user's foot;

a pulley support being coupled between each of said foot members, said pulley support being aligned with an apex of each of said foot members;

a pulley being rotatably coupled to said pulley support, said pulley being centrally positioned between said foot members, a pair of cables, each of said cables being coupled to said resistance unit such that each of said cables is selectively drawn outwardly from said resistance unit, said resistance unit biasing each of said cables to be drawn inwardly therein wherein said resistance unit is configured to impart resistance in each of said cables for performing the rowing exercises, each of said cables having a distal end with respect to said resistance unit, said cable extending around said pulley having said distal end of each of said cables being positioned between said resistance unit and said second end of said seat track;

a pair of handles, each of said handles being coupled to said distal end of a respective one of said cables wherein each of said handles is configured to be gripped for performing the rowing exercises, each of said handles having a first end, said first end of each of said handles being releasably coupled together having said handles defining a bar; and a control being positioned proximate to said rowing machine wherein said control is configured to be manipulated by the user, each of said elevation units being electrically coupled to said control such that said control actuates each of said elevation units to be positioned at said selected point between said minimum and maximum elevations, said control comprising:

a control member being coupled to and extending rearwardly from said pulley support, said control member having a distal end with respect to said pulley support;

a housing having a back wall and a front wall, said front wall being coupled to said distal end of said control member wherein said back wall is configured to be visible to the user;

a control circuit being positioned within said housing, said control circuit having said motor of each of said elevation units being electrically coupled thereto, said resistance unit being electrically coupled to said control circuit;

a display being coupled to said back wall of said housing, said display being electrically coupled to said control circuit, said display displaying indicia comprising operational parameters of said elevation units and said resistance unit;

a plurality of buttons, each of said buttons being movably coupled to said back wall of said housing, each of said buttons being electrically coupled to said control circuit for controlling said operational parameters of said elevation units and said resistance unit; and a power cord being coupled to and extending outwardly from said housing, said power cord having a distal end, said distal end of said power cord having a plug being electrically coupled thereto, said plug being electrically coupled to a power source.

* * * * *